US009359890B2

(12) United States Patent
Purkis

(10) Patent No.: US 9,359,890 B2
(45) **Date of Patent: *Jun. 7, 2016**

(54) METHOD OF AND APPARATUS FOR COMPLETING A WELL

(71) Applicant: Petrowell Limited, Aberdeen (GB)

(72) Inventor: Daniel Purkis, Peterhead (GB)

(73) Assignee: Petrowell Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/743,440

(22) Filed: Jun. 18, 2015

(65) Prior Publication Data

US 2015/0285063 A1 Oct. 8, 2015

Related U.S. Application Data

(63) Continuation of application No. 14/048,796, filed on Oct. 8, 2013, now Pat. No. 9,085,954, which is a continuation of application No. 12/677,660, filed as application No. PCT/GB2008/050951 on Oct. 17, 2008, now Pat. No. 8,833,469.

(30) Foreign Application Priority Data

Oct. 19, 2007 (GB) ..... 0720421.7

(51) Int. Cl.
*E21B 47/12* (2012.01)
*E21B 34/06* (2006.01)
(Continued)

(52) U.S. Cl.
CPC ..... *E21B 47/122* (2013.01); *E21B 23/06* (2013.01); *E21B 33/12* (2013.01); *E21B 34/066* (2013.01); *E21B 47/124* (2013.01)

(58) Field of Classification Search
CPC ..... E21B 47/122; E21B 34/066; E21B 33/12; E21B 23/06; E21B 47/124; E21B 34/00; E21B 2034/002; E21B 2034/005
See application file for complete search history.

(56) References Cited

U.S. PATENT DOCUMENTS 3,227,228 A 1/1966 Bannister
3,233,674 A 2/1966 Leutwyler
(Continued)

FOREIGN PATENT DOCUMENTS

EP 0593122 A2 4/1994
EP 1214501 B1 4/2005
(Continued)

OTHER PUBLICATIONS

Georgescu, Mihnea, "International Search Report", for PCT/GB2008/050951 as mailed Nov. 19, 2009, 7 pages.
(Continued)

*Primary Examiner* — Yong-Suk (Philip) Ro
(74) *Attorney, Agent, or Firm* — Winstead PC

(57) ABSTRACT

A completion apparatus for completing a wellbore includes a tool to alternatively open and close a throughbore; a tool to alternatively open and close an annulus between the outer surface of the completion and the inner surface of the wellbore; a tool to alternatively provide and prevent a fluid circulation route from the throughbore of the completion to the annulus; and at least one signal receiver and processing tool capable of decoding signals received. The apparatus is run into the well bore, the throughbore is closed and the fluid pressure in the tubing is increased to pressure test the completion; the annulus is closed and a fluid circulation route is provided from the throughbore to the annulus and fluid is circulated through the production tubing into the annulus and back to surface. The fluid circulation route is then closed and the throughbore is opened.

31 Claims, 12 Drawing Sheets

(51) Int. Cl.
*E21B 33/12* (2006.01)
*E21B 23/06* (2006.01)

(56) References Cited

U.S. PATENT DOCUMENTS 3,503,445 A 3/1970 Cochrum et al.
3,914,732 A 10/1975 Brumleve et al.
3,941,190 A 3/1976 Conover
4,367,794 A 1/1983 Bednar et al.
4,432,417 A 2/1984 Bowyer
4,617,960 A 10/1986 More
4,698,631 A 10/1987 Kelly, Jr. et al.
4,712,613 A 12/1987 Nieuwstad
4,782,695 A 11/1988 Glotin et al.
4,796,699 A 1/1989 Upchurch
4,856,595 A 8/1989 Upchurch
4,896,722 A 1/1990 Upchurch
4,915,168 A 4/1990 Upchurch
5,142,128 A 8/1992 Perkin et al.
5,146,983 A 9/1992 Hromas et al.
5,152,340 A 10/1992 Clark et al.
5,203,414 A 4/1993 Hromas et al.
5,226,491 A * 7/1993 Pringle ..... E21B 17/06 166/66.7
5,226,494 A 7/1993 Rubbo et al.
5,289,372 A 2/1994 Guthrie et al.
5,343,963 A 9/1994 Bouldin et al.
5,360,967 A 11/1994 Perkin et al.
5,558,153 A 9/1996 Holcombe et al.
5,579,283 A 11/1996 Owens et al.
5,611,401 A 3/1997 Myers, Jr. et al.
5,706,896 A 1/1998 Tubel et al.
5,893,413 A 4/1999 Lembcke et al.
5,991,602 A 11/1999 Sturm
6,012,518 A 1/2000 Pringle et al.
6,021,095 A 2/2000 Tubel et al.
6,055,213 A 4/2000 Rubbo et al.
6,058,773 A 5/2000 Zimmerman et al.
6,109,357 A 8/2000 Zimmerman
6,244,351 B1 6/2001 Patel et al.
6,308,137 B1 10/2001 Underhill et al.
6,333,699 B1 12/2001 Zierolf
6,333,700 B1 12/2001 Thomeer et al.
6,343,649 B1 2/2002 Beck et al.
6,347,292 B1 2/2002 Denny et al.
6,349,772 B2 2/2002 Mullen et al.
6,359,569 B2 3/2002 Beck et al.
6,384,738 B1 5/2002 Carstensen et al.
6,388,577 B1 5/2002 Carstensen
6,414,905 B1 7/2002 Owens et al.
6,443,228 B1 9/2002 Aronstam et al.
6,480,811 B2 11/2002 Denny et al.
6,481,505 B2 11/2002 Beck et al.
6,488,082 B2 12/2002 Echols et al.
6,497,280 B2 12/2002 Beck et al.
6,536,524 B1 3/2003 Snider
6,588,505 B2 7/2003 Beck et al.
6,597,175 B1 7/2003 Brisco
6,604,063 B2 8/2003 Denny et al.
6,624,759 B2 9/2003 Tubel et al.
6,684,953 B2 2/2004 Sonnier
6,710,720 B2 3/2004 Carstensen et al.
6,745,833 B2 6/2004 Aronstam et al.
6,759,968 B2 7/2004 Zierolf
6,760,275 B2 7/2004 Carstensen
6,776,240 B2 8/2004 Kenison et al.
6,782,948 B2 8/2004 Echols et al.
6,789,619 B2 9/2004 Carlson et al.
6,802,373 B2 10/2004 Dillenbeck et al.
6,915,848 B2 7/2005 Thomeer et al.
6,935,425 B2 8/2005 Aronstam
6,973,416 B2 12/2005 Denny et al.
6,976,535 B2 12/2005 Aronstam et al.
6,989,764 B2 1/2006 Thomeer et al.
7,014,100 B2 3/2006 Zierolf
7,025,146 B2 4/2006 King et al.
7,044,229 B2 5/2006 Tennoy et al.
7,062,413 B2 6/2006 Denny et al.
7,063,148 B2 6/2006 Jabusch
7,066,256 B2 6/2006 Dillenbeck et al.
7,084,769 B2 8/2006 Bauer et al.
7,128,154 B2 10/2006 Giroux et al.
7,159,654 B2 1/2007 Ellison et al.
RE39,583 E 4/2007 Upchurch
7,201,231 B2 4/2007 Chaplin et al.
7,252,152 B2 8/2007 LoGiudice et al.
7,273,102 B2 9/2007 Sheffield
7,275,602 B2 10/2007 Green et al.
7,283,061 B1 10/2007 Snider et al.
7,295,491 B2 11/2007 Carstensen
7,296,462 B2 11/2007 Gregory et al.
7,322,410 B2 1/2008 Vinegar et al.
7,337,850 B2 3/2008 Contant
7,385,523 B2 6/2008 Thomeer et al.
7,389,205 B2 6/2008 Denny et al.
7,400,263 B2 7/2008 Snider et al.
7,455,108 B2 11/2008 Jenkins et al.
7,484,625 B2 2/2009 Scott et al.
7,500,389 B2 3/2009 Green et al.
7,503,398 B2 3/2009 LoGiudice et al.
7,510,001 B2 3/2009 Spring et al.
7,543,637 B2 6/2009 Green et al.
7,562,712 B2 7/2009 Cho et al.
7,588,100 B2 9/2009 Hamilton
7,591,318 B2 9/2009 Tilghman
7,606,682 B2 10/2009 Denny et al.
7,634,942 B2 12/2009 Green et al.
7,665,527 B2 2/2010 Loretz
7,714,741 B2 5/2010 Snider et al.
7,912,678 B2 3/2011 Denny et al.
7,946,356 B2 5/2011 Koederitz et al.
7,958,715 B2 6/2011 Kinert et al.
7,963,452 B2 6/2011 Moritz
8,016,037 B2 9/2011 Bloom et al.
8,833,469 B2 * 9/2014 Purkis ..... E21B 33/12 166/250.01
2002/0029883 A1 3/2002 Vinegar et al.
2002/0043369 A1 4/2002 Vinegar et al.
2003/0029611 A1 2/2003 Owens
2003/0174099 A1 9/2003 Bauer et al.
2004/0239521 A1 12/2004 Zierolf
2005/0230109 A1 10/2005 Kammann et al.
2006/0087448 A1 4/2006 Den Boer et al.
2006/0124310 A1 6/2006 Lopez de Cardenas et al.
2006/0175404 A1 8/2006 Zierolf
2007/0124220 A1 5/2007 Griggs et al.
2007/0267221 A1 11/2007 Giroux et al.
2007/0272411 A1 11/2007 Lopez De Cardenas et al.
2007/0285275 A1 12/2007 Purkis et al.
2008/0000690 A1 1/2008 Lynde
2008/0041597 A1 2/2008 Fisher et al.
2008/0105427 A1 5/2008 Hampton et al.
2008/0128126 A1 6/2008 Dagenais et al.
2008/0128168 A1 6/2008 Purkis et al.
2008/0149345 A1 6/2008 Marya et al.
2008/0245534 A1 10/2008 Purkis
2008/0271887 A1 11/2008 Snider et al.
2009/0044937 A1 2/2009 Purkis
2009/0065214 A1 3/2009 Purkis
2009/0090502 A1 4/2009 Lumbye et al.
2009/0114401 A1 5/2009 Purkis
2009/0115624 A1 5/2009 Tinnen et al.
2009/0121895 A1 5/2009 Denny et al.
2009/0151939 A1 6/2009 Bailey et al.
2009/0208295 A1 8/2009 Kinert et al.
2009/0223663 A1 9/2009 Snider et al.
2009/0223670 A1 9/2009 Snider
2009/0230340 A1 9/2009 Purkis
2009/0266544 A1 10/2009 Redlinger et al.
2009/0272544 A1 11/2009 Giroux et al.
2009/0283454 A1 11/2009 Scott et al.
2010/0044034 A1 2/2010 Bailey et al.
2010/0089583 A1 4/2010 Xu et al.
2010/0170681 A1 7/2010 Purkis

(56) References Cited

U.S. PATENT DOCUMENTS

| | | | |
|---|---|---|---|
| 2010/0200243 | A1 | 8/2010 | Purkis |
| 2010/0200244 | A1 | 8/2010 | Purkis |
| 2011/0148603 | A1 | 6/2011 | Denny et al. |
| 2011/0204143 | A1 | 8/2011 | Mackenzie et al. |
| 2011/0248566 | A1 | 10/2011 | Purkis |
| 2012/0065126 | A1 | 3/2012 | Bruser et al. |

FOREIGN PATENT DOCUMENTS

| | | | |
|---|---|---|---|
| EP | 1669541 | A1 | 6/2006 |
| GB | 2148355 | A | 5/1985 |
| GB | 2276675 | A | 10/1994 |
| GB | 2420133 | A | 5/2006 |
| WO | 9205533 | A1 | 4/1992 |
| WO | 00/73625 | A1 | 12/2000 |
| WO | WO-03080993 | A1 | 10/2003 |
| WO | WO-2004/072434 | A2 | 8/2004 |
| WO | 2006046075 | A2 | 5/2006 |
| WO | 2006051250 | A1 | 5/2006 |
| WO | 2006062407 | A1 | 8/2006 |
| WO | 2006082421 | A1 | 8/2006 |
| WO | 2006109008 | A1 | 10/2006 |
| WO | 2006120466 | A2 | 11/2006 |
| WO | WO-2007/108700 | A1 | 9/2007 |
| WO | 2007125335 | A1 | 11/2007 |
| WO | WO-2007125335 | A1 | 11/2007 |
| WO | 2008059260 | A2 | 5/2008 |
| WO | 2009/050518 | A2 | 4/2009 |
| WO | 2009050517 | A2 | 4/2009 |
| WO | 2009098512 | A2 | 8/2009 |
| WO | 2009109788 | A1 | 9/2009 |
| WO | 2009114356 | A1 | 9/2009 |
| WO | 2010038072 | A1 | 4/2010 |
| WO | 2010086654 | A1 | 8/2010 |
| WO | 2010149643 | A1 | 12/2010 |
| WO | 2010149644 | A1 | 12/2010 |
| WO | WO-2012065123 | A2 | 5/2012 |
| WO | WO-2012065126 | A2 | 5/2012 |

OTHER PUBLICATIONS

Fraley: Karen, et al., "RFID Technology for Downhole Well Applications," Exploration & Production—Oil & Gas Review 2007—OTC Edition, 3 pages.

Snider, Philip M., et al.. "AADE 20099NTCE-16-04: RFID Downhole Tools and Development for the Drilling Environment" AADE 2009 National Technical Conference & Exhibition, New Orleans, Louisiana, 2009NTCE-16-04 Tech Paper, pp. 1-3.

Runge, Paul, "Petrowell Operations Report," Petrowell RFID Circulation Sub First Deployment for CNR International, Aug. 25, 2005, 11 pages.

*Hubertus* v. *Thomeer, et al.* v. *Snider, et al.*, Patent Interference No. 105,466 (SCM) (Technology Center 2600), Before the Board of Patent Appeals and Interferences, Entered Nov. 21, 2006. 3 pages.

M-1 Swaco, Company News. JPT. May 2008, 1 page.

* cited by examiner

SECTION B-B

SECTION A-A

METHOD OF AND APPARATUS FOR COMPLETING A WELL

CROSS-REFERENCE TO RELATED APPLICATIONS

This application is a continuation of U.S. patent application Ser. No. 14/048,796, which was filed on Oct. 8, 2013. U.S. patent application Ser. No. 14/048,796 is a continuation of U.S. patent application Ser. No. 12/677,660, which entered the national stage under 35 U.S.C. 371 on Mar. 11, 2010. U.S. patent application Ser. No. 12/677,660 is a national-stage filing of PCT/GB2008/050951, filed Oct. 17, 2008. PCT/GB2008/050951 claims priority to GB 0720421.7, filed Oct. 19, 2007. U.S. patent application Ser. Nos. 12/677,660 and 14/048,796, PCT/GB2008/050951, and GB 0720421.7 are incorporated herein by reference.

BACKGROUND

1. Field of the Invention

The present invention relates to a method of completing a well and also to one or more devices for use downhole and more particularly but not exclusively relates to a substantially interventionless method for completing an oil and gas wellbore with a production tubing string and a completion without requiring intervention equipment such as slick line systems to set downhole tools to install the completion.

2. History of the Related Art

Conventionally, as is well known in the art, oil and gas wellbores are drilled in the land surface or subsea surface with a drill bit on the end of a drillstring. The drilled borehole is then lined with a casing string (and more often than not a liner string which hangs off the bottom of the casing string). The casing and liner string if present are cemented into the wellbore and act to stabilise the wellbore and prevent it from collapsing in on itself.

Thereafter, a further string of tubulars is inserted into the cased wellbore, the further string of tubulars being known as the production tubing string having a completion on its lower end. The completion/production string is required for a number of reasons including protecting the casing string from corrosion/abrasion caused by the produced fluids and also for safety and is used to carry the produced hydrocarbons from the production zone up to the surface of the wellbore.

Conventionally, the completion/production string is run into the cased borehole where the completion/production string includes various completion tools such as:—

- a barrier which may be in the form of a flapper valve or the like;
- a packer which can be used to seal the annulus at its location between the outer surface of the completion string and the inner surface of the casing in order to ensure that the produced fluids all flow into the production tubing; and
- a circulation sleeve valve used to selectively circulate fluid from out of the throughbore of the production tubing and into the annulus between the production string and the inner surface of the casing string in order to for example flush kill fluids up the annulus and out of the wellbore.

It is known to selectively activate the various completion tools downhole in order to set the completion in the cased wellbore by one of two main methods. Firstly, the operator of the wellbore can use intervention equipment such as tools run into the production tubing on slickline that can be used to set e.g. the barrier, the packer or the circulation sleeve valve. However, such intervention equipment is expensive as an intervention rig is required and there are also a limited number of intervention rigs and also personnel to operate the rigs and so significant delays and costs can be experienced in setting a completion.

Alternatively, the completion/production string can be run into the cased wellbore with for example electrical cables that run from the various tools up the outside of the production string to the surface such that power and control signals can be run down the cables. However, the cables are complicated to fit to the outside of the production string because they must be securely strapped to the outside of the string and also must pass over the joints between each of the individual production tubulars by means of cable protectors which are expensive and timely to fit. Furthermore, it is not unknown for the cables to be damaged as they are run into the wellbore which means that the production tubing must be pulled out of the cased wellbore and further delays and expense are experienced.

It would therefore be desirable to be able to obviate the requirement for either cables run from the downhole completion up to the surface and also the need for intervention to be able to set the various completion tools.

SUMMARY

According to a first aspect of the present invention there is a completion apparatus for completing a wellbore comprising:— a) a tool to alternatively open and close a throughbore of the completion;

b) a tool to alternatively open and close an annulus defined between the outer surface of the completion and the inner surface of the wellbore;

c) a tool to alternatively provide and prevent a fluid circulation route through a sidewall of the completion from the throughbore of the completion to the said annulus;

d) a signal processing tool capable of decoding signals received relating to the operation of tools a) to c); and e) a tool comprising a powered actuation mechanism capable of operating tools a) to c) under instruction from tool d).

According to a first aspect of the present invention there is a method of completing a wellbore comprising the steps of:— i) running in a completion comprising a plurality of production tubulars and one or more downhole completion tools, the completion tools comprising:— a) a means to alternatively open and close a throughbore of the completion;

b) a means to alternatively open and close an annulus defined between the outer surface of the completion and the inner surface of the wellbore;

c) a means to alternatively provide and prevent a fluid circulation route through a sidewall of the completion from the throughbore of the completion to the said annulus;

d) a signal processing means capable of decoding signals received relating to operation of tools a) to c); and e) a tool comprising a powered actuation mechanism capable of operating tools a) to c) under instruction from tool d);

ii) wherein tool d) instructs tool e) to operate tool a) to close the throughbore of the completion;

iii) increasing the pressure within the fluid in the tubing to pressure test the completion;

iv) wherein tool d) instructs tool e) to operate tool b) to close the said annulus;

v) wherein tool d) instructs tool e) to operate tool c) to provide said fluid circulation route such that fluid can be circulated through the production tubing and out into the annulus and back to surface;

vi) wherein tool d) instructs tool e) to operate tool c) to prevent the said fluid circulation route; and vii) wherein tool d) instructs tool e) to operate tool a) to open the throughbore of the completion.

Preferably, tool d) may further comprise at least one signal receiving means capable of receiving signals sent from the surface, said signals being input into the signal processing means and said signals preferably being transmitted from surface without requiring intervention into the completion and without requiring cables to transmit power and signals from surface to the completion and further preferably comprises transmitting data wirelessly and more preferably comprises either or both of:— coding a means to carry data at the surface with the signal, introducing the means to carry data into the fluid path such that it flows toward and through at least a portion of the completion such that the signal is received by the said signal receiving means and most preferably the means to carry data comprises an RFID tag; and/or sending the signal via a change in the pressure of fluid contained within the throughbore of the completion and more preferably comprises sending the signal via a predetermined frequency of changes in the pressure of fluid contained within the throughbore of the completion such that a second signal receiving means detects said signal and typically further comprises verifying that tool b) has been operated to close the said annulus.

Additionally or optionally tool d) may comprise a timed instruction storage means provided with a series of instructions and associated operational timings for instructing tool e) to operate tools a) to c) wherein the method further comprises storing the instructions in the storage means at surface prior to running the completion into the wellbore.

According to a second aspect of the present invention there is a method of completing a wellbore comprising the steps of:— i) running in a completion comprising a plurality of production tubulars and one or more downhole completion tools, the completion tools comprising:— a) a means to alternatively open and close a throughbore of the completion;

b) a means to alternatively open and close an annulus defined between the outer surface of the completion and the inner surface of the wellbore; and c) a means to alternatively provide and prevent a fluid circulation route from the throughbore of the completion to the said annulus; and d) at least one signal receiver means and a signal processing means;

ii) transmitting a signal arranged to be received by at least one of the signal receiver means of tool d) wherein the signal contains an instruction to operate tool a) to close the throughbore of the completion;

iii) increasing the pressure within the fluid in the tubing to pressure test the completion;

iv) transmitting a signal arranged to be received by at least one of the signal receiver means of tool d) wherein the signal contains an instruction to operate tool b) to close the said annulus;

v) transmitting a signal arranged to be received by at least one of the signal receiver means of tool d) wherein the signal contains an instruction to operate tool c) to provide a fluid circulation route from the throughbore of the completion to the said annulus and circulating fluid through the production tubing and out into the annulus and back to surface;

vi) transmitting a signal arranged to be received by at least one of the signal receiver means of tool d) wherein the signal contains an instruction to operate tool c) to prevent the fluid circulation route from the throughbore of the completion to the said annulus such that fluid is prevented from circulating; and vii) transmitting a signal arranged to be received by at least one of the signal receiver means of tool d) wherein the signal contains an instruction to operate tool a) to open the throughbore of the completion.

Preferably, the completion tools of the method according to the second aspect further comprise e) a tool comprising a powered actuation mechanism capable of operating tools a) to c) under instruction from tool d).

Typically, the production tubulars form a string of production tubulars. Typically, the method relates to completing a cased wellbore, and the apparatus is for completing a cased wellbore.

Preferably, step ii) further comprises transmitting the signal without requiring intervention into the completion and without requiring cables to transmit power and signals from surface to the completion and further preferably comprises transmitting data wirelessly and more preferably comprises coding a means to carry data at the surface with the signal, introducing the means to carry data into the fluid path such that it flows toward and through at least a portion of the completion such that the signal is received by the said signal receiver means of tool d) and most preferably the means to carry data comprises an RFID tag.

Preferably step iii) further comprises increasing the pressure within the fluid in the tubing to pressure test the completion by increasing the pressure of fluid at the surface of the well in communication with fluid in the throughbore of the completion above the closed tool a).

Preferably step iv) further comprises transmitting the signal without requiring intervention into the completion and without requiring cables to transmit power and signals from surface to the completion and further preferably comprises transmitting data wirelessly and more preferably comprises sending the signal via a change in the pressure of fluid contained within the throughbore of the completion and most preferably comprises sending the signal via a predetermined frequency of changes in the pressure of fluid contained within the throughbore of the completion such that a second signal receiving means of tool d) detects said signal and typically further comprises verifying that tool b) has operated to close the said annulus.

Preferably step v) further comprises transmitting the signal without requiring intervention into the completion and without requiring cables to transmit power and signals from surface to the completion and further preferably comprises transmitting data wirelessly and more preferably comprises sending the signal via a change in the pressure of fluid contained within the throughbore of the completion and most preferably comprises sending the signal via a different predetermined frequency of changes in the pressure of fluid contained within the throughbore of the completion compared to the frequency of step iv) such that the second signal receiving means of tool d) detects said signal and acts to operate tool c) to provide a fluid circulation route from the throughbore of the completion to the said annulus.

Preferably step vi) further comprises transmitting the signal without requiring intervention into the completion and without requiring cables to transmit power and signals from surface to the completion and further preferably comprises transmitting data wirelessly and more preferably comprises coding a means to carry data at the surface with the signal, introducing the means to carry data into the fluid path such that it flows toward and through at least a portion of the completion such that the signal is received by the said first signal receiver means of tool d) and most preferably the means to carry data comprises an RFID tag.

Preferably step vii) further comprises transmitting the signal without requiring intervention into the completion and without requiring cables to transmit power and signals from surface to the completion and further preferably comprises transmitting data wirelessly and more preferably comprises sending the signal via a change in the pressure of fluid contained within the throughbore of the completion and most preferably comprises sending the signal via a different predetermined frequency of changes in the pressure of fluid contained within the throughbore of the completion compared to the frequency of steps iv) and v) such that the second signal receiving means of tool d) detects said signal and acts to operate tool a) to open the throughbore of the completion.

Preferably, tool c) is located, within the production string, closer to the surface of the well than either of tool a) and tool b).

Typically, tool c) is run into the well in a closed configuration such that fluid cannot flow from the throughbore of the completion to the said annulus via side ports formed in tool c). Typically, tool c) comprises a circulation sub.

Typically, tool a) is run into the well in an open configuration such that fluid can flow through the throughbore of the completion without being impeded or prevented by tool a). Typically, tool a) comprises a valve which may comprise a ball valve or flapper valve.

Typically, tool b) is run into the wellbore in an unset configuration such that the annulus is not closed by it during running in and typically, tool b) comprises a packer or the like.

Preferably, the at least one signal receiving means capable of receiving signals sent from the surface of tool d) comprises an RFID tag receiving coil and the second signal receiving means of tool d) preferably comprises a pressure sensor.

Preferably, tool d) and e) can be formed in one tool having multiple features and preferably tool e) comprises an electrical power means which may comprise an electrical power storage means in the form of one or more batteries, and tool e) further preferably comprises an electrical motor driven by the batteries that can provide motive power to operate, either directly or indirectly, tools a) to c). Typically, tool e) preferably comprises an electrical motor driven by the batteries to move a piston to provide hydraulic fluid power to operate tools a) to c).

According to a further aspect of the present invention there is provided a downhole needle valve tool comprising:— an electric motor having a rotational output;

an obturating member for obturating a fluid pathway;

wherein the obturating member is rotationally coupled to the rotational output of the electric motor;

and wherein rotation of the obturating member results in axial movement of the obturating member relative to the electric motor and the fluid pathway;

such that rotation of the obturating member in one direction results in movement of the obturating member into sealing engagement with the fluid pathway and rotation of the obturating member in the other direction results in movement of the obturating member out of sealing engagement with the fluid pathway.

Preferably, the obturating member comprises a needle member and the fluid pathway comprises a seat into which the needle may be selectively inserted in order to seal the fluid pathway and thereby selectively allow and prevent fluid to flow along the fluid pathway.

Preferably, the needle valve tool is used to allow for selective energisation of a downhole sealing member, typically with a downhole fluid and piston, and more preferably the downhole sealing member is a packer tool and the downhole fluid is fluid from the throughbore of a completion/production tubing. Alternatively, the packer could be hydraulically set by pressure from a downhole pump tool operated by tool e) of the first aspect or by an independent pressure source.

BRIEF DESCRIPTION OF THE DRAWINGS

Embodiments in accordance with the present invention will now be described by way of example only with reference to the accompanying drawings, in which:—

DETAILED DESCRIPTION

Figure 1:
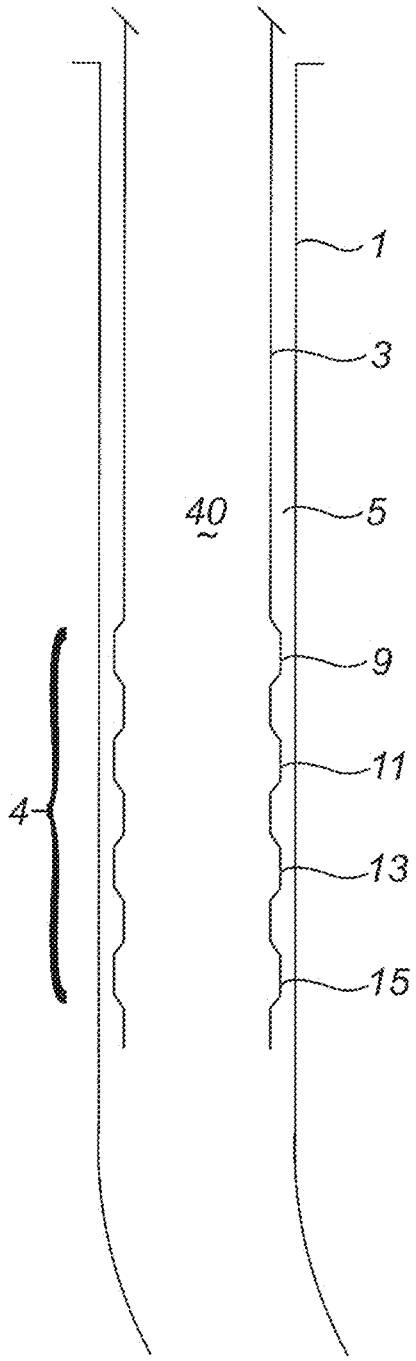
FIG. 1 is a schematic overview of a completion in accordance with the present invention having just been run into a cased well.

A production string 3 made up of a number (which could be hundreds) of production tubulars having screw threaded connections is shown with a completion 4 at its lower end in FIG. 1 where the production tubing string 3 and completion 4 have just been run into a cased well 1. In order to complete the oil and gas production well such that production of hydrocarbons can commence, the completion 4 needs to be set into the well.

In accordance with the present invention, the completion 4 comprises a wireless remote control central power unit 9 provided at its upper end with a circulation sleeve sub 11 located next in line vertically below the central power unit 9. A packer 13 is located immediately below the circulation sleeve sub 11 and a barrier 15, which may be in the form of a valve such as a ball valve but which is preferably a flapper valve 15, is located immediately below the packer 13. Importantly, the circulation sleeve sub 11 is located above the packer 13 and the barrier 15.

Figure 2:
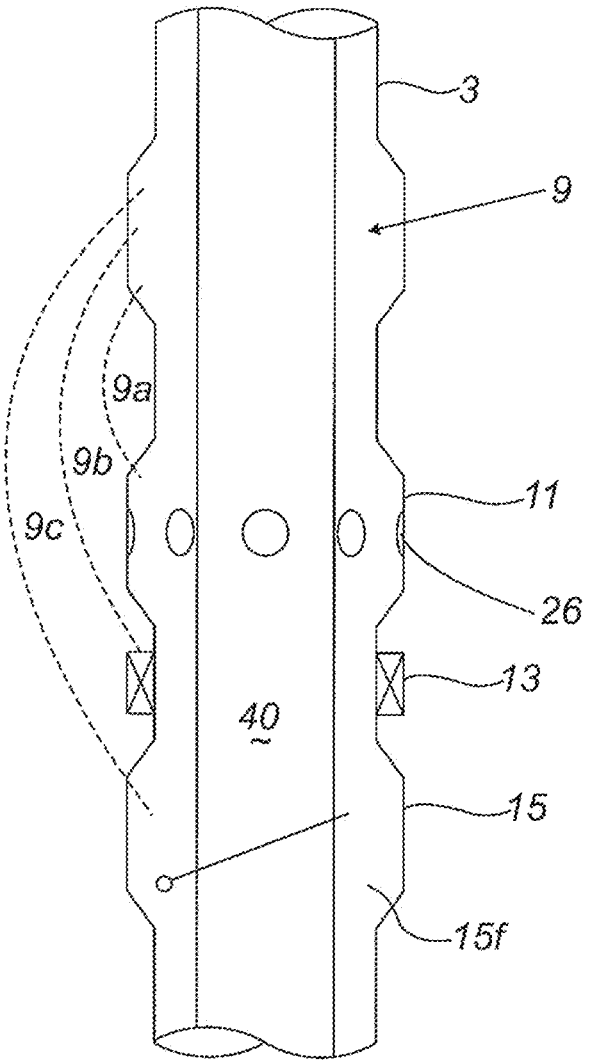
FIG. 2 is a schematic overview of the completion tools in accordance with the present invention as shown in FIG. 1.

A control means 9A, 9B, 9C is shown schematically in FIG. 2 in dotted lines as leading from the wireless remote control central power unit 9 to each of the circulation sleeve sub 11, packer 13 and barrier 15 where the control means may be in the form of electrical cables, but as will be described subsequently is preferably in the form of a conduit capable of transmitting hydraulic fluid.

As shown in FIG. 1 and as is common in the art, there is an annulus 5 defined between the outer circumference of the completion 4/production string 3 and the inner surface of the cased wellbore 1.

In order to safely install the completion 4 in the cased wellbore 1, the following sequence of events are observed.

The completion 4 is run into the cased wellbore 1 with the flapper valve 15 in the open configuration, that is with the flapper 15F not obturating the throughbore 40 such that fluid can flow in the throughbore 40. Furthermore, the packer 13 is run into the cased wellbore 1 in the unset configuration which means that it is clear of the casing 1 and does not try to obturate the annulus 5 as it is being run in. Additionally, the circulation sleeve sub 11 is run in the closed configuration which means that the apertures 26 (which are formed through the side wall of the circulation sleeve sub 11) are closed by a sliding sleeve 100 provided on the inner bore of the circulation sleeve sub 11 as will be described subsequently and thus the apertures 26 are closed such that fluid cannot flow through them and therefore the fluid must flow all the way through the throughbore 40 of the completion 4 and production string 3.

An interventionless method of setting the completion 4 in the cased wellbore 1 will now be described in general with a specific detailed description of the main individual tools following subsequently. It will be understood by those skilled in the art that an interventionless method of setting a completion provides many advantages to industry because it means that the completion does not need to be set by running in setting tools on slick line or running the completion into the wellbore with electric power/data cables running all the way up the side of the completion and production string.

Figure 3:
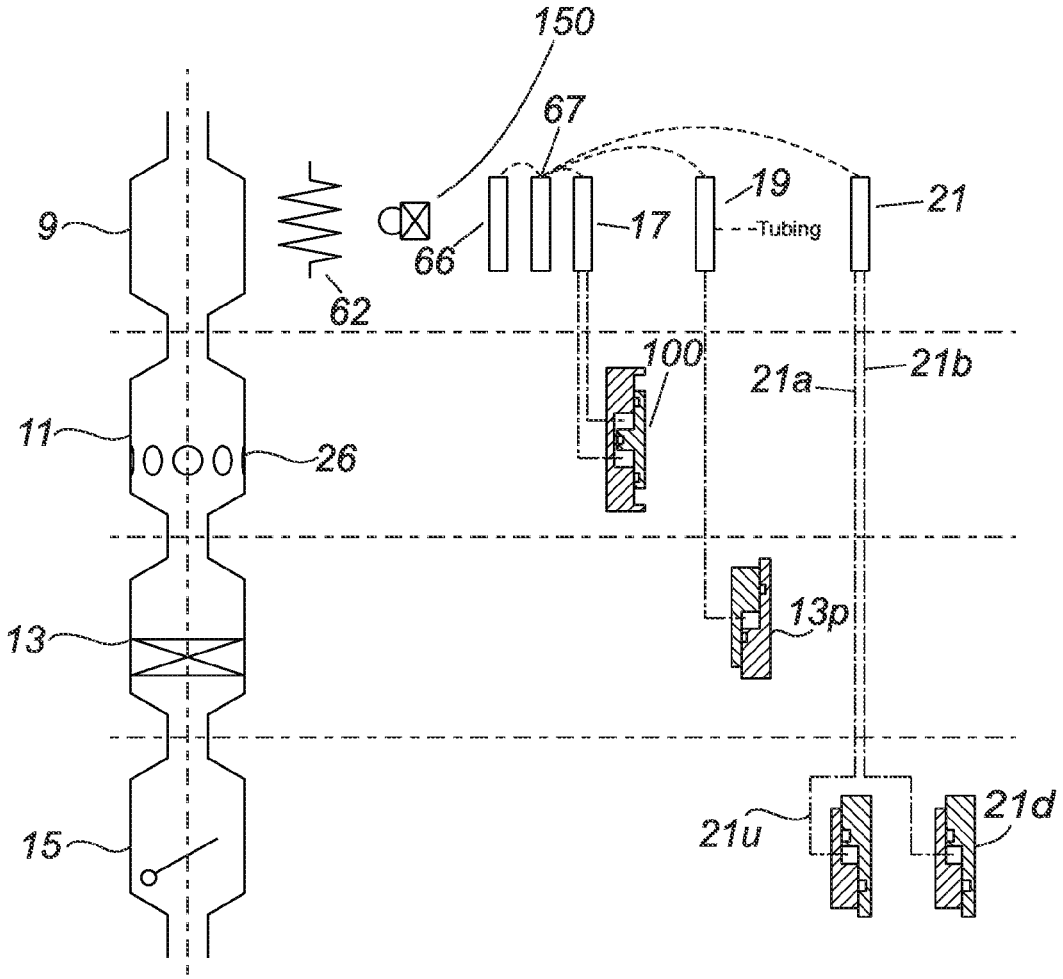
FIG. 3 is a further schematic overview of the completion tools of FIG. 2 showing a simplified hydraulic fluid arrangement.
Figure 4:
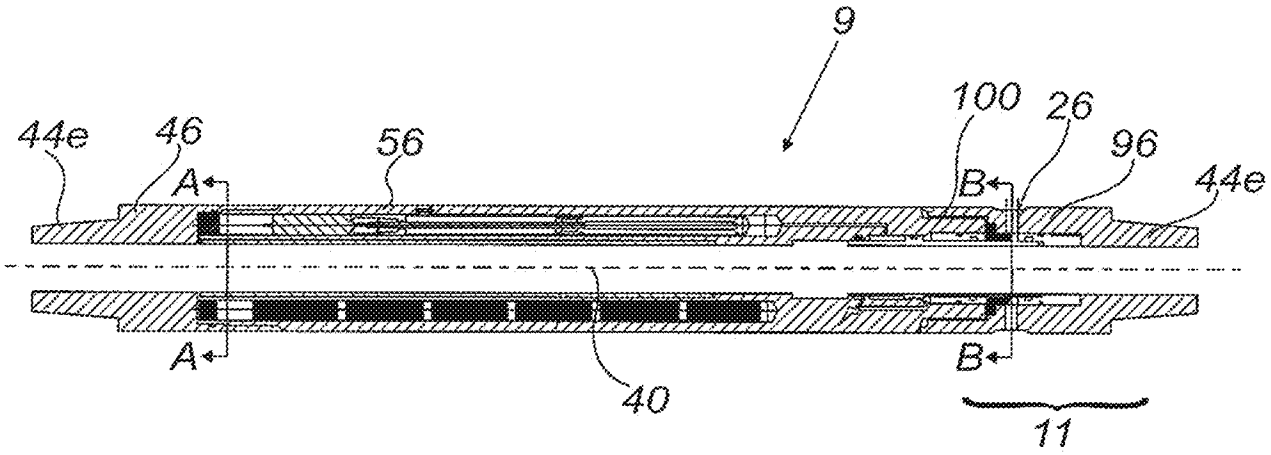
FIG. 4 is a sectional view of a downhole device according to the second aspect of the invention.

The wireless remote control central power unit 9 will be described in more detail subsequently, but in general comprises (as shown in FIG. 3):— an RFID tag detector 62 in the form of an antenna 62 and which provides a first means to detect signals sent from the surface (which are coded on to RFID tags at the surface by the operator and then dropped into the well);

a pressure signature detector 150 which can be used to detect peaks in fluid pressure in the completion tubing throughbore 40 (where the pressure peaks are applied at the surface by the operator and are transmitted down the fluid contained within the throughbore 40 and therefore provide a second means for the operator to send signals to the central power unit 9);

a battery pack 66 which provides all the power requirements to the central power unit 9;

an electronics package 67 which has been coded at the surface by the operator with the instructions on which tools 11, 13, 15 to operate depending upon which signals are received by one of the two receivers 62, 150;

a first electrical motor and hydraulic pump combination 17 which, when operated, will control the opening or closing of the sleeve 100 of the circulation sleeve sub 11;

a motorised downhole needle valve tool 19 (which could well actually form part of the packer 13 and therefore be housed within the packer instead of forming part of and being housed within the central power unit 9); and a second electric motor and hydraulic pump combination 21 which has two hydraulic fluid outlets 21A, 21B which are respectively used to provide hydraulic pressure to a first hydraulic chamber 21U within the fall through flapper 15 and which is arranged to rotate the flapper valve 15 upwards when hydraulic fluid is pumped into the chamber 21U in order to open the throughbore 40 and a second hydraulic fluid chamber 21D also located within the fall through flapper 15 and which is arranged to move the flapper down in order to close the throughbore 40 when required.

In general, the completion 4 is set into the cased wellbore 1 by following this sequence of steps:— a) the completion 4 is run into the cased hole with the flapper 15 in the open configuration such that the throughbore 40 is open, the circulation sleeve sub 11 is in the closed configuration such that the apertures 26 are closed and the packer 13 is in the unset configuration;

b) in order to be able to subsequently pressure test the completion tubing (see step C below) the flapper valve 15 must be closed. This is achieved by inserting an RFID tag into fluid at the surface of the wellbore and which is pumped down through the throughbore 40 of the production string 3 and completion 4. The RFID tag is coded at the surface with an instruction to tell the central power unit 9 to close the fall through flapper 15. The RFID detector 62 detects the RFID tag as it passes through the central power unit 9 and the electronic package 67 decodes the signal detected by the antenna 62 as an instruction to close the flapper valve 15. This results in the electronics package 67 (powered by the battery pack 66) instructing the second electric motor plus hydraulic pump combination 21 to pump hydraulic fluid through conduit 21B into the chamber 21D which results in closure of the fall through flapper valve 15;

c) a tubing pressure test is then typically conducted to check the integrity of the production tubing 3 as there could be many hundreds of joints of tubing screwed together to form the production tubing string 3. The pressure test is conducted by increasing the pressure of the fluid at surface in communication with the fluid contained in the throughbore 40 of the production string 3 and completion 4;

d) assuming the tubing pressure test is successful, the next stage is to set the packer 13 but because the flapper valve 15 is now closed it would be unreliable to rely on dropping an RFID tag down the production tubing fluid because there is no flow through the fluid and the operator would need to rely on gravity alone which would be very unreliable. Instead, a pressure signature detector 150 is used to sense increases in pressure of the production fluid within the throughbore 40 as will be subsequently described. Accordingly, the operator sends the required predetermined signal in the form of two or more pre-determined pressure pulses sent within a predetermined frequency which when concluded is sensed by the pressure signature detector 150 and is decoded by the electronics package 67 which results in the operation of the motorised downhole needle valve tool 19 (as will be detailed subsequently) to open a conduit between a packing setting chamber 13P and the throughbore of the production tubing 3 to allow production tubing fluid to enter the packing setting chamber 13P to inflate the packer. The setting of the packer 13 can be tested in the usual way; that is by increasing the pressure in the annulus at surface to confirm the packer 13 holds the pressure;

e) It is important to remove the heavy kill fluids which are located in the production tubing above the packer 13. This is done by sending a second signal of two or more pre-determined pressure peaks sent within a different predetermined frequency which when concluded is sensed by the pressure signature detector 150 and is decoded by the electronics package 67 as an instruction to open the circulation sleeve sub 11. Accordingly, the electronics package 67 instructs the first electric motor and hydraulic pump combination 17 to move the sleeve 100 in the required direction to uncover the apertures 26. Accordingly, circulation fluid such as a brine or diesel can be pumped down the production string 3, through the throughbore 40, out of the apertures 26 and back up the annulus 5 to the surface where the heavy kill fluids can be recovered;

f) an RFID tag is then coded at surface with the predetermined instruction to close the circulation sleeve sub 11 and the RFID tag is introduced into the circulation fluid flow path down the throughbore 40. The RFID detector 62 will detect the signal carried on the coded RFID tag and this is decoded by the electronics package 67 which will instruct the electric motor and hydraulic pump combination 17 to move the circulation sleeve 100 in the opposite direction to the direction it was moved in step e) above such that the apertures 26 are covered up again and sealed and thus the circulation fluid flow path is stopped; and g) the final step in the method of setting the completion is to open the flapper valve 15 and this is done by using a third signal of two or more pre-determined pressure peaks sent within a different predetermined frequency which travels down the static fluid contained in the throughbore 40 such that it is detected by the pressure signature detector 150 and the signal is decoded by the electronics package 67 to operate the electric motor and hydraulic pump combination 21 to pump hydraulic fluid down the conduit 21*a* and into the hydraulic chamber 21*u* which moves the flapper to open the throughbore 40.

The well has now been completed with the completion 4 being set and, provided all other equipment is ready, the hydrocarbons or produced fluids can be allowed to flow from the hydrocarbon reservoir up through the throughbore 40 in the completion 4 and the production tubing string 3 to the surface whenever desired.

The key completion tools will now be described in detail.

The central power unit 9 is shown in FIGS. 4 to 9 as being largely formed in one tool housing along with the circulation sleeve sub 11 where the central power unit 9 is mainly housed within a top sub 46 and a middle sub 56 and the circulation sleeve sub 11 is mainly housed within a bottom sub 96, each of which comprise a substantially cylindrical hollow body. In this embodiment, the packer 13 and the flapper valve 15 could each be similarly provided with their own respective central power units (not shown), each of which are provided with their own distinct codes for operation. However, an alternative embodiment could utilise one central power unit 9 as shown in detail in FIGS. 4 to 9 but modified with separate hydraulic conduits leading to the respective tools 11, 13, 15 as generally shown in FIGS. 1 to 3.

The wireless remote controlled central power unit 9 (shown in FIGS. 4 to 9) has pin ends 44*e* enabling connection with a length of adjacent production tubing or pipe 42.

When connected in series for use, the hollow bodies of the top sub 46, middle sub 56 and bottom sub 96 define a continuous throughbore 40.

Figure 5:
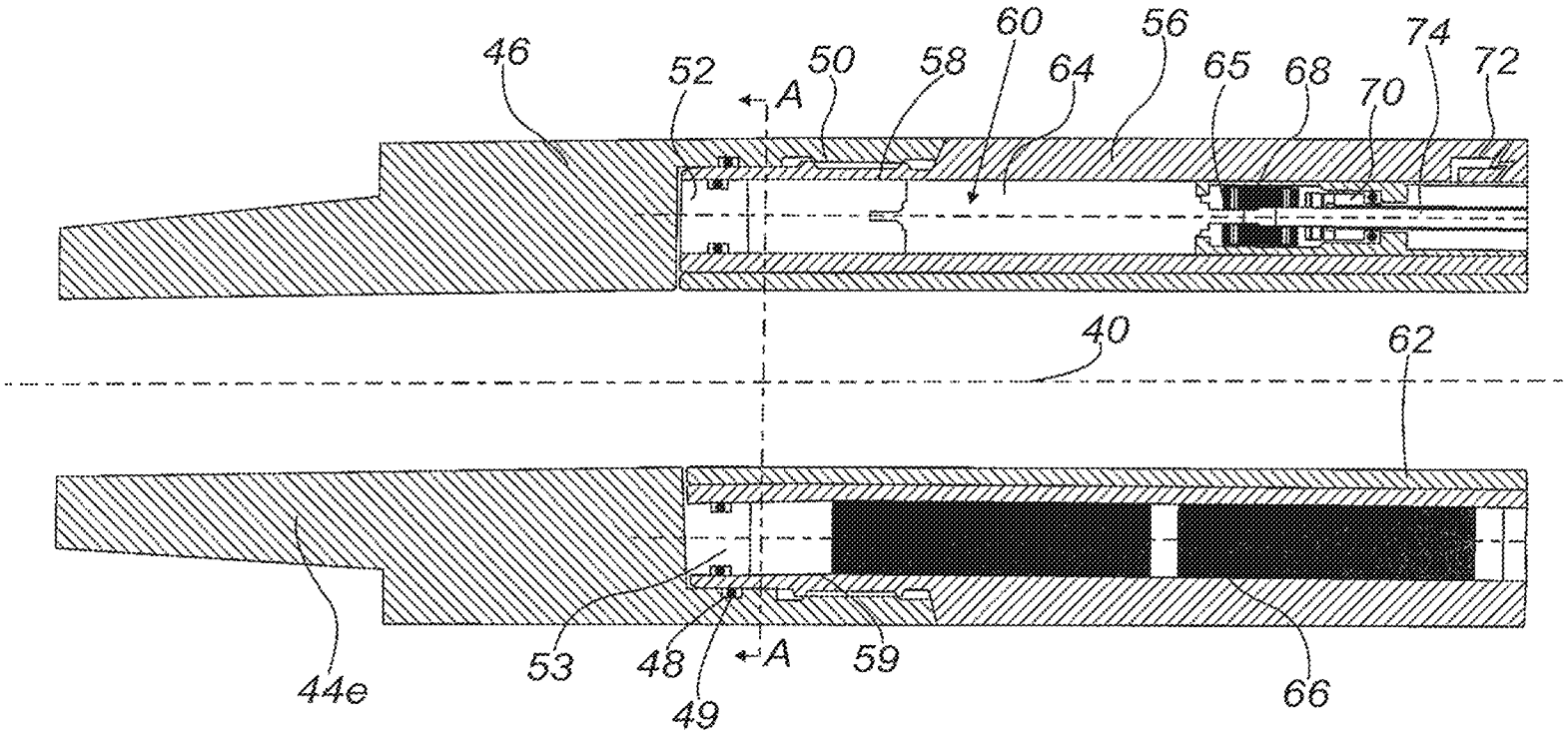
FIGS. 5-7 are detailed sectional consecutive views of the device shown in FIG. 4.

As shown in FIG. 5, the top sub 46 and the middle sub 56 are secured by a threaded pin and box connection 50. The threaded connection 50 is sealed by an O-ring seal 49 accommodated in an annular groove 48 on an inner surface of the box connection of the top sub 46. Similarly, the top sub 96 of the circulation sleeve sub 11 and the middle sub 56 of the central control unit 9 are joined by a threaded connection 90 (shown in FIG. 7).

An inner surface of the middle sub 56 is provided with an annular recess 60 that creates an enlarged bore portion in which an antenna 62 is accommodated co-axial with the middle sub 56. The antenna 62 itself is cylindrical and has a bore extending longitudinally therethrough. The inner surface of the antenna 62 is flush with an inner surface of the adjacent middle sub 56 so that there is no restriction in the throughbore 40 in the region of the antenna 62. The antenna 62 comprises an inner liner and a coiled conductor in the form of a length of copper wire that is concentrically wound around the inner liner in a helical coaxial manner. Insulating material separates the coiled conductor from the recessed bore of the middle sub 56 in the radial direction. The liner and insulating material is typically formed from a non-magnetic and non-conductive material such as fibreglass, moulded rubber or the like. The antenna 62 is formed such that the insulating material and coiled conductor are sealed from the outer environment and the throughbore 40. The antenna 62 is typically in the region of 10 metres or less in length.

Two substantially cylindrical tubes or bores 58, 59 are machined in a sidewall of the middle sub 56 parallel to the longitudinal axis of the middle sub 56. The longitudinal machined bore 59 accommodates a battery pack 66. The machined bore 58 houses a motor and gear box 64 and a hydraulic piston assembly shown generally at 60. Ends of both of the longitudinal bores 58, 59 are sealed using a seal assembly 52, 53 respectively. The seal assembly 52, 53 includes a solid cylindrical plug of material having an annular groove accommodating an O-ring to seal against an inner surface of each machined bore 58, 59.

An electronics package 67 (but not shown in FIG. 4) is also accommodated in a sidewall of the middle sub 56 and is electrically connected to the antenna 62, the motor and gear box 64. The electronics package, the motor and gear box 64 and the antenna 62 are all electrically connected to and powered by the battery pack 66.

Figure 6:
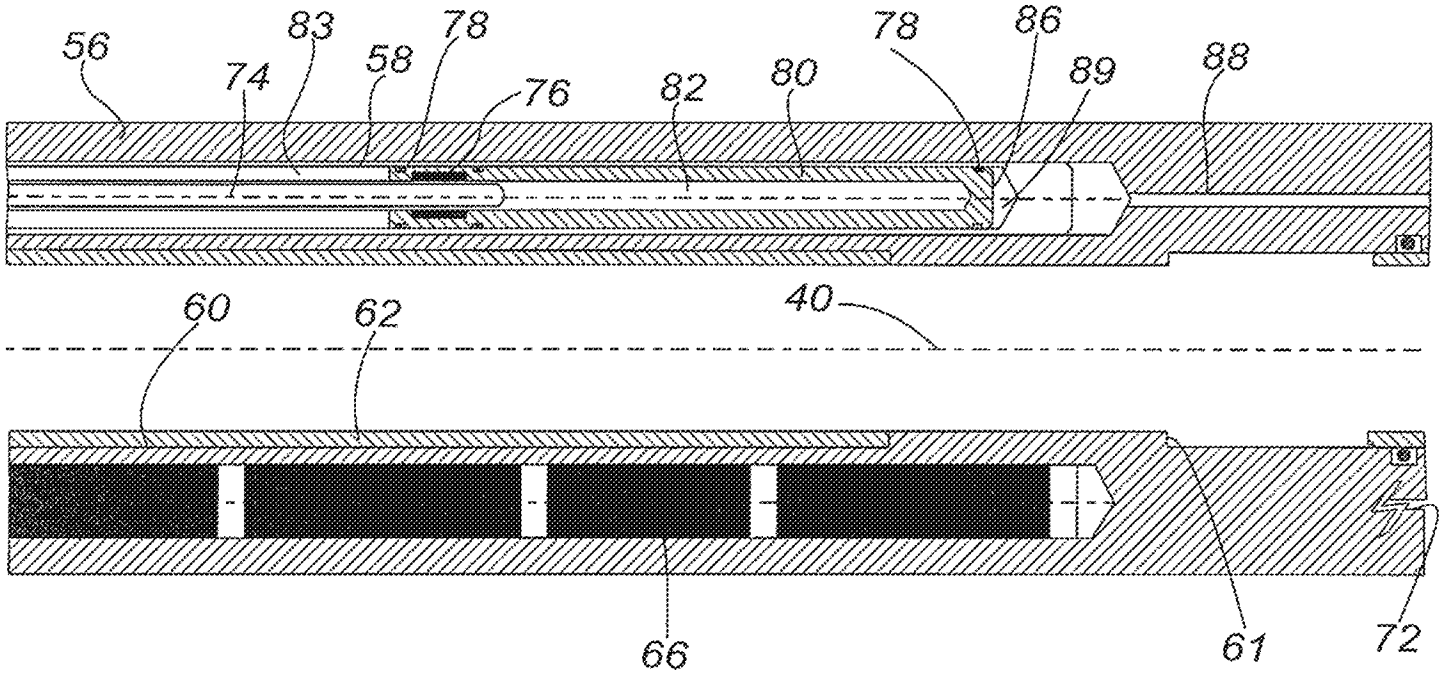
Figure 7:
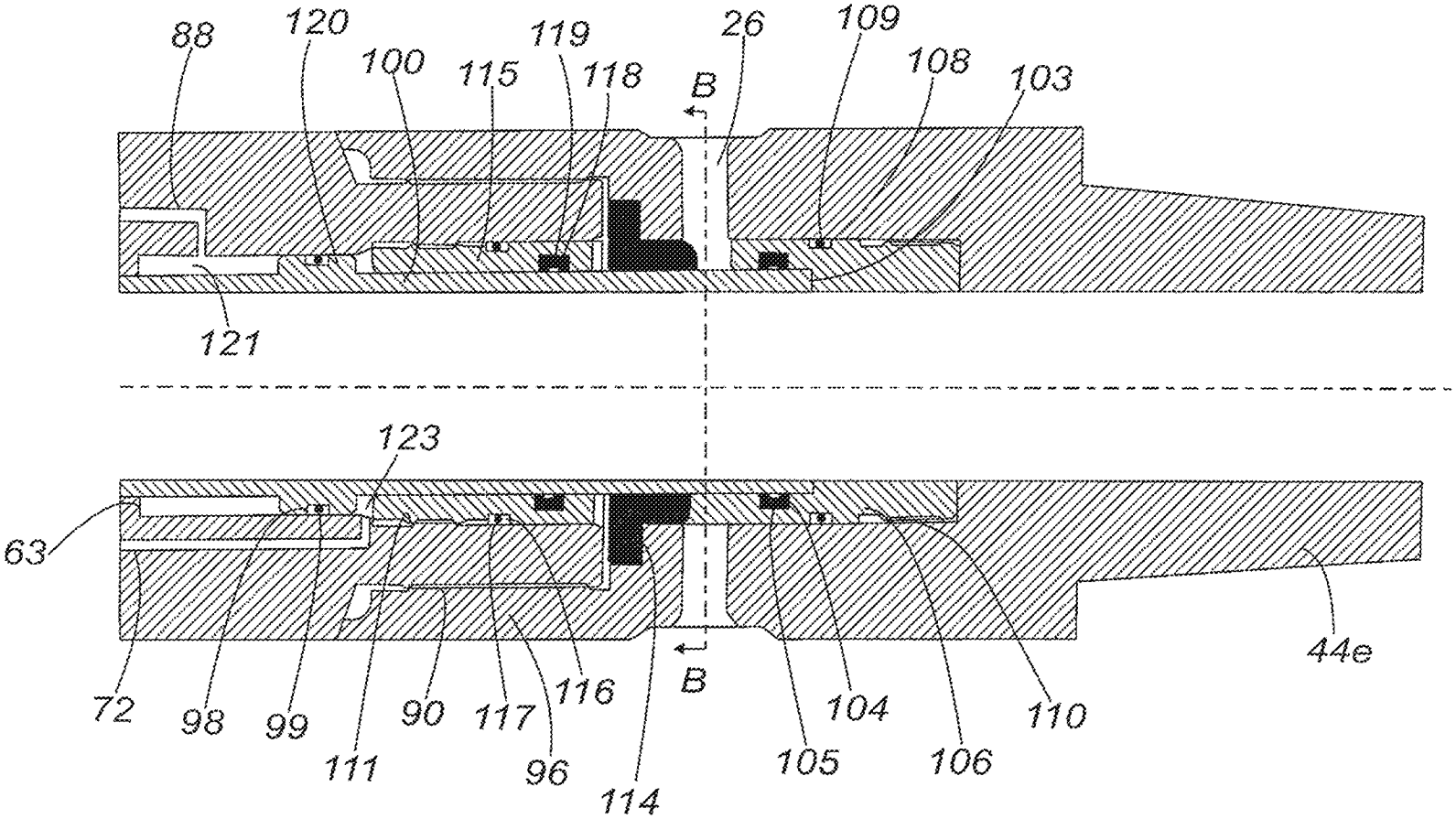
Figure 9:
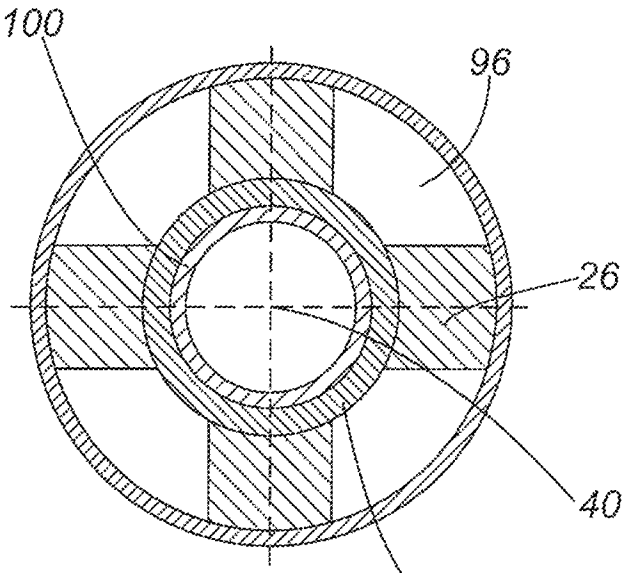
FIG. 9 is a view on section B-B shown in FIG. 7.
Figure 8:
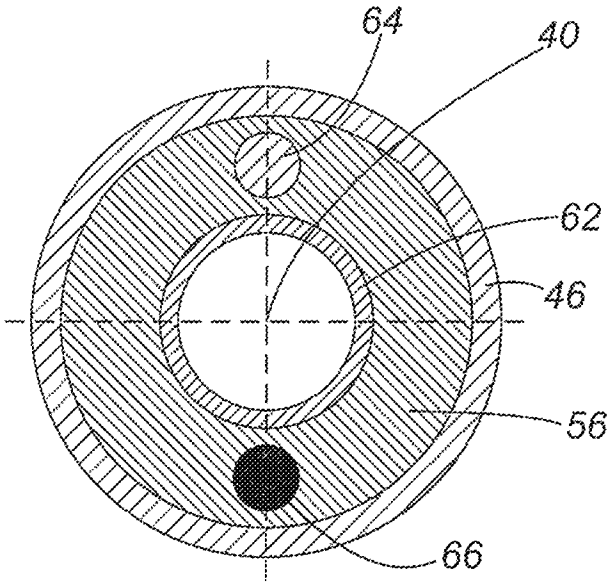
FIG. 8 is a view on section A-A shown in FIG. 5.

The motor and gear box 64 when actuated rotationally drive a motor arm 65 which in turn actuates a hydraulic piston assembly 60. The hydraulic piston assembly 60 comprises a threaded rod 74 coupled to the motor arm 65 via a coupling 68 such that rotation of the motor arm 65 causes a corresponding rotation of the threaded rod 74. The rod 74 is supported via thrust bearing 70 and extends into a chamber 83 that is approximately twice the length of the threaded rod 74. The chamber 83 also houses a piston 80 which has a hollowed centre arranged to accommodate the threaded rod 74. A threaded nut 76 is axially fixed to the piston 80 and rotationally and threadably coupled to the threaded rod 74 such that rotation of the threaded rod 74 causes axial movement of the nut 76 and thus the piston 80. Outer surfaces of the piston 80 are provided with annular wiper seals 78 at both ends to allow the piston 80 to make a sliding seal against the chamber 83 wall, thereby fluidly isolating the chamber 83 from a second chamber 89 ahead of the piston 80 (on the right hand side of the piston 80 as shown in FIG. 6). The chamber 83 is in communication with a hydraulic fluid line 72 that communicates with a piston chamber 123 (described hereinafter) of the sliding sleeve 100. The second chamber 89 is in communication with a hydraulic fluid line 88 that communicates with a piston chamber 121 (described hereinafter) of the sliding sleeve 100.

A sliding sleeve 100 having an outwardly extending annular piston 120 is sealed against the inner recessed bore of the middle sub 56. The sleeve 100 is shown in a first closed configuration in FIGS. 4 to 9 in that apertures 26 are closed by the sliding sleeve 100 and thus fluid in the throughbore 40 cannot pass through the apertures 40 and therefore cannot circulate back up the annulus 5.

An annular step 61 is provided on an inner surface of the middle sub 56 and leads to a further annular step 63 towards the end of the middle sub 56 that is joined to the top sub 96. Each step creates a throughbore 40 portion having an enlarged or recessed bore. The annular step 61 presents a shoulder or stop for limiting axial travel of the sleeve 100. The annular step 63 presents a shoulder or stop for limiting axial travel of the annular piston 120.

An inner surface at the end of the middle sub 56 has an annular insert 115 attached thereto by means of a threaded connection 111. The annular insert 115 is sealed against the inner surface of the middle sub 56 by an annular groove 116 accommodating an O-ring seal 117. An inner surface of the annular insert 115 carries a wiper seal 119 in an annular groove 118 to create a seal against the sliding sleeve 100.

The top sub 96 of the circulating sub 11 has four ports 26 (shown in FIG. 9) extending through the sidewall of the circulating sub 11. In the region of the ports 26, the top sub 96 has a recessed inner surface to accommodate an annular insert 106 in a location vertically below the ports 26 in use and an annular insert 114 that is L-shaped in section vertically above the port 26 in use. The annular insert 106 is sealed against the top sub 96 by an annular groove 108 accommodating an O-ring seal 109. An inner surface of the annular insert 106 provides an annular step 103 against which the sleeve 100 can seat. An inner surface of the insert 106 is provided with an annular groove 104 carrying a wiper seal 105 to provide a sliding seal against the sleeve 100. The insert 114 is made from a hard wearing material so that fluid flowing through the port 26 does not result in excessive wear of the top sub 96 or middle sub 56.

The sleeve 100 is shown in FIGS. 4 to 9 occupying a first, closed, position in which the sleeve 100 abuts the step 103 provided on the annular insert 106 and the annular piston 120 is therefore at one end of its stroke thereby creating a first annular piston chamber 121. The piston chamber 121 is bordered by the sliding sleeve 100, the annular piston 120, an inner surface of the middle sub 56 and the annular step 63. The sleeve 100 is moved into the configuration shown in FIGS. 4 to 9 by pumping fluid into the chamber 121 via conduit 88.

The annular piston 120 is sealed against the inner surface of the middle sub 56 by means of an O-ring seal 99 accommodated in an annular recess 98. Axial travel of the sleeve 100 is limited by the annular step 61 at one end and the sleeve seat 103 at the other end.

The sleeve 100 is sealed against wiper seals 105, 119 when in the first closed configuration and the annular protrusion 120 seals against an inner surface of the middle sub 56 and is moveable between the annular step 63 on the inner surface of the middle sub 56 and the annular insert 115.

In the second, open configuration, the throughbore 40 is in fluid communication with the annulus 5 when the ports 26 are uncovered. The sleeve 100 abuts the annular step 61 in the second position so that the fluid channel between the ports 26 and the throughbore 40 of the bottom sub 96 and the annulus 5 is open. The sleeve 100 is moved into the second (open) configuration, when circulation of fluid from the throughbore 40 into the annulus 5 is required, by pumping fluid along conduit 72 into chamber 123 which is bounded by seals 117 and 119 at its lowermost end and seal 99 at its upper most end.

RFID tags (not shown) for use in conjunction with the apparatus described above can be those produced by Texas Instruments such as a 32 mm glass transponder with the model number RI-TRP-WRZB-20 and suitably modified for application downhole. The tags should be hermetically sealed and capable of withstanding high temperatures and pressures. Glass or ceramic tags are preferable and should be able to withstand 20,000 psi (138 MPa). Oil filled tags are also well suited to use downhole, as they have a good collapse rating.

An RFID tag (not shown) is programmed at the surface by an operator to generate a unique signal. Similarly, each of the electronics packages coupled to the respective antenna 62 if separate remote control units 9 are provided or to the one remote control unit 9 if it is shared between the tools 11, 13, 15, prior to being included in the completion at the surface, is separately programmed to respond to a specific signal. The RFID tag comprises a miniature electronic circuit having a transceiver chip arranged to receive and store information and a small antenna within the hermetically sealed casing surrounding the tag.

Once the borehole has been drilled and cased and the well is ready to be completed, completion 4 and production string 3 is run downhole. The sleeve 100 is run into the wellbore 1 in the open configuration such that the ports 26 are uncovered to allow fluid communication between the throughbore 40 and the annulus.

When required to operate a tool 11, 13, 15 and circulation is possible (i.e. when the sleeve 100 is in the open configuration), the pre-programmed RFID tag is weighted, if required, and dropped or flushed into the well with the completion fluid. After travelling through the throughbore 40, the selectively coded RFID tag reaches the remote control unit 9 the operator wishes to actuate and passes through the antenna 62 thereof which is of sufficient length to charge and read data from the tag. The tag then transmits certain radio frequency signals, enabling it to communicate with the antenna 62. This data is then processed by the electronics package.

As an example the RFID tag in the present embodiment has been programmed at the surface by the operator to transmit information instructing that the sleeve 100 of the circulation sleeve sub 11 is moved into the closed position. The electronics package 67 processes the data received by the antenna 62 as described above and recognises a flag in the data which corresponds to an actuation instruction data code stored in the electronics package 67. The electronics package 67 then instructs the motor 17; 60, powered by battery pack 66, to drive the hydraulic piston pump 80. Hydraulic fluid is then pumped out of the chamber 89, through the hydraulic conduit line 88 and into the chamber 121 to cause the chamber 121 to fill with fluid thereby moving the sleeve 100 downwards into the closed configuration. The volume of hydraulic fluid in chamber 123 decreases as the sleeve 100 is moved towards the shoulder 103. Fluid exits the chamber 123 along hydraulic conduit line 72 and is returned to the hydraulic fluid reservoir 83. When this process is complete the sleeve 100 abuts the shoulder 103. This action therefore results in the sliding sleeve 100 moving downwards to obturate port 26 and close the path from the throughbore 40 of the completion 4 to the annulus 5.

Therefore, in order to actuate a specific tool 11, 13, 15, for example circulation sleeve sub 11, a tag programmed with a specific frequency is sent downhole. In this way tags can be used to selectively target specific tools 11, 13, 15 by pre-programming the electronics package to respond to certain frequencies and programming the tags with these frequencies. As a result several different tags may be provided to target different tools 11, 13, 15 at the same time.

Several tags programmed with the same operating instructions can be added to the well, so that at least one of the tags will reach the desired antenna 62 enabling operating instructions to be transmitted. Once the data is transferred the other RFID tags encoded with similar data can be ignored by the antenna 62.

Any suitable packer 13 could be used particularly if it can be selectively actuated by inflation with fluid from within the throughbore 40 of the completion 4 and a suitable example of such a packer 13 is a 50-ACE packer offered by Petrowell of Dyce, Aberdeen, UK.

Figure 10:
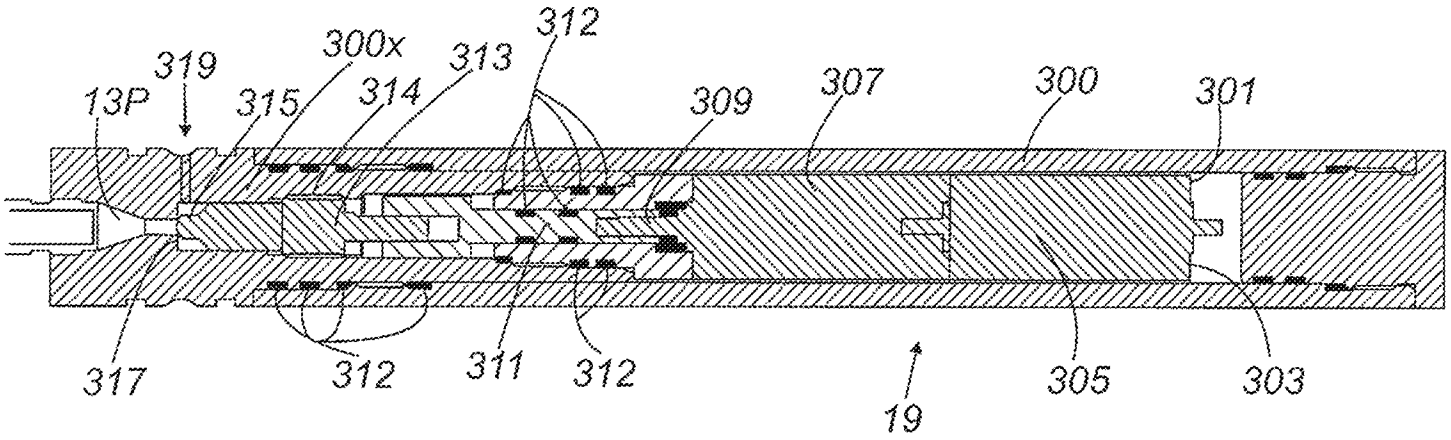
FIG. 10 is a cross-sectional view of a motorised downhole needle valve tool used to operate the packer of FIGS. 1-3.

An embodiment of a motorised downhole needle valve tool 19 for enabling inflation of the packer 13 will now be described and is shown in FIG. 10.

The needle valve tool 19 comprises an outer housing 300 and is typically formed either within or is located in close proximity to the packer 13. Positive 301 and negative 303 dc electric terminals are connected via suitable electrical cables (not shown) to the electronics package 67 where the terminals 301, 303 connect into an electrical motor 305, the rotational output of which is coupled to a gear box 307. The rotational output of the gearbox 307 is rotationally coupled to a needle shaft 313 via a splined coupling 311 and there are a plurality of O-ring seals 312 provided to ensure that the electric motor 305 and gear box 307 remain sealed from the completion fluid in the throughbore 40. The splined connection between the coupling 311 and the needle shaft 313 ensures that the needle shaft is rotationally locked to the coupling 311 but can move axially with respect thereto. The needle 315 is formed at the very end of the needle shaft 313 and is arranged to selectively seal against a seat 317 formed in the portion of the housing 300*x*. Furthermore, the needle shaft 313 is in screw threaded engagement with the housing 300*x* via screw threads 314 in order to cause axial movement of the needle shaft 313 (either toward or away from seat 317) when it is rotated.

When the needle 315 is in the sealing configuration shown in FIG. 10 with the seat 317, completion fluid in the throughbore 40 of the production tubing 3 is prevented from flowing through the hydraulic fluid port to tubing 319 and into the packer setting chamber 13P. However, when the electric motor 305 is activated in the appropriate direction, the result is rotation of the needle shaft 313 and, due to the screw threaded engagement 314, axial movement away from the seat 317 which results in the needle 315 parting company from the seat 317 and this permits fluid communication through the seat 317 from the hydraulic fluid port 319 into the packer setting chamber 13*p* which results in the packer 13 inflating.

A suitable example of a barrier 15 will now be described.

The barrier 15 is preferably a fall through flapper valve 15 such as that described in PCT Application No GB2007/001547, the full contents of which are incorporated herein by reference, but any suitable flapper valve or ball valve that can be hydraulically operated could be used (and such a ball valve is a downhole Formation Saver Valve (FSV) offered by Weatherford of Aberdeen, UK) although it is preferred to have as large (i.e. unrestricted) an inner diameter of the completion 4 when open as possible.

Figure 11:
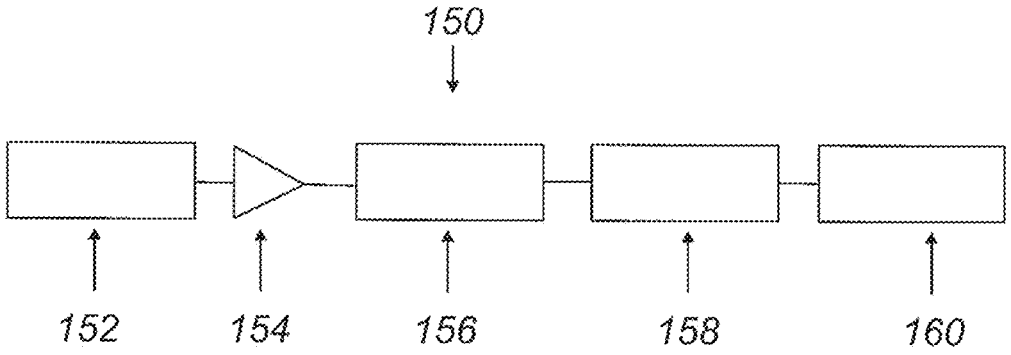
FIG. 11 is a schematic representation of a pressure signature detector for use with the present invention.

FIG. 11 shows a frequency pressure actuated apparatus 150 and which is preferably used instead of a conventional mechanical pressure sensor (not shown) in order to receive pressure signals sent from the surface in situations when the well is shut in (i.e. when barrier 15 is closed) and therefore no circulation of fluid can take place and thus no RFID tags can be used.

The apparatus 150 comprises a pressure transducer 152 which is capable of sensing the pressure of well fluid located within the throughbore 40 of the production tubing string 3 and outputting a voltage having an amplitude indicative thereof.

Figure 12:
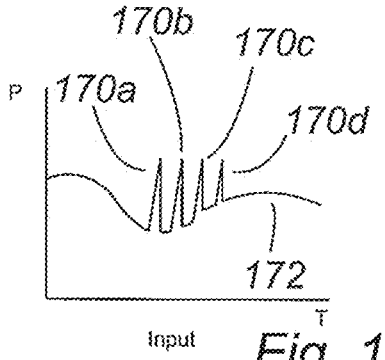
FIG. 12 is the actual pressure sensed at the downhole tool in the well fluid of signals applied at surface to downhole fluid in accordance with the method of the present invention.

As an example, FIG. 12 shows a typical electrical signal output from the pressure transducer where a pressure pulse sequence 170A, 170B, 170C, 170D is clearly shown as being carried on the general well fluid pressure which, as shown in FIG. 12 is oscillating much more slowly and represented by sine wave 172. Again, as before, this pressure pulse sequence 170A-170D is applied to the well fluid contained within the production tubing string 3 at the surface of the wellbore.

However, unlike conventional mechanical pressure sensors, the presence of debris above the downhole tool and its attenuation effect in reducing the amplitude of the pressure signals will not greatly affect the operation of the apparatus 150.

Figure 13:
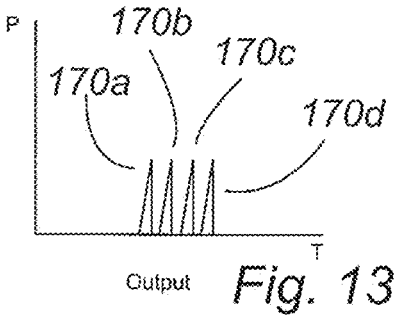
FIG. 13 is a graph of the pressure versus time of the well fluid after the pressure has been output from a high pass filter of FIG. 11 and is representative of the pressure that is delivered to the software in the microprocessor as shown in FIG. 11.

The apparatus 150 further comprises an amplifier to amplify the output of the pressure transducer 152 where the output of the amplifier is input into a high pass filter which is arranged to strip the pressure pulse sequence out of the signal as received by the pressure transducer 152 and the output of the high pass filter 156 is shown in FIG. 13 as comprising a "clean" set of pressure pulses 170A-170D. The output of the high pass filter 156 is input into an analogue/digital converter 158, the output of which is input into a programmable logic unit comprising a microprocessor containing software 160.

Figure 14:
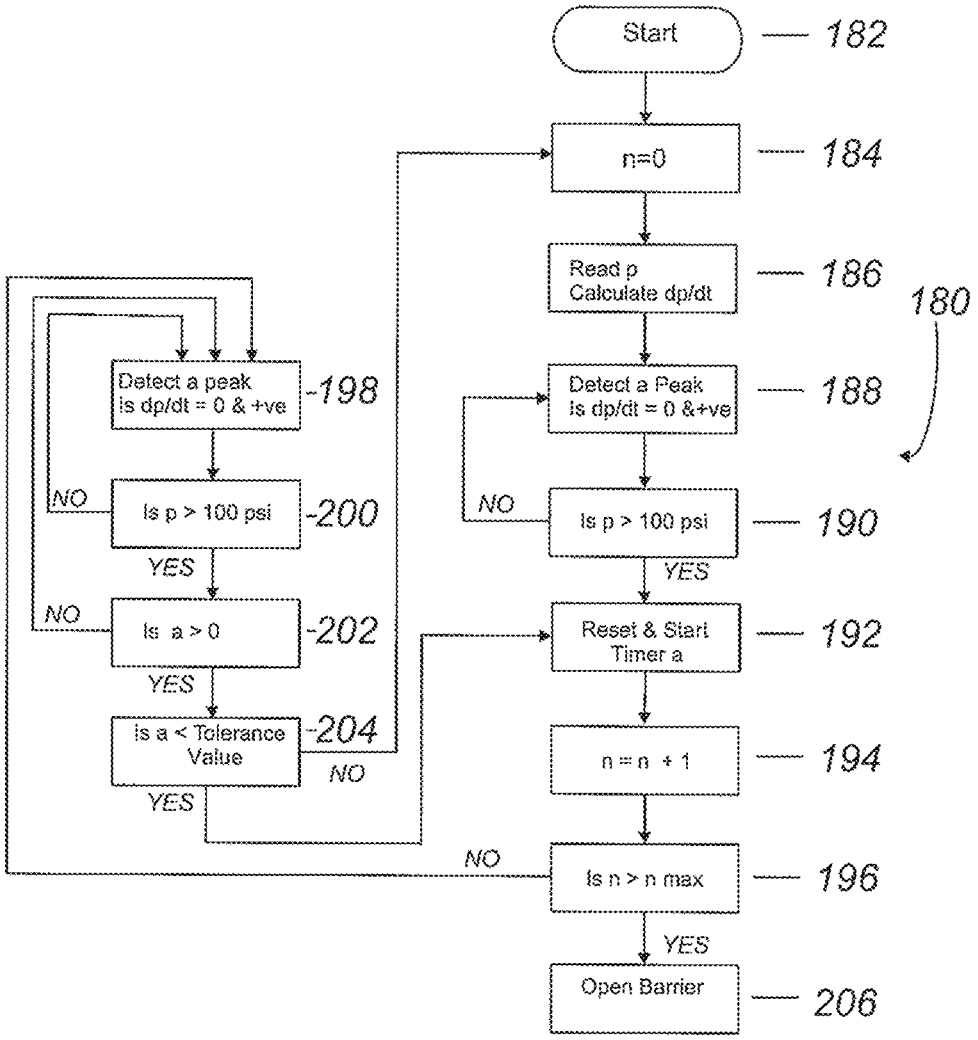
FIG. 14 is a flow chart of the main decisions made by the software of the pressure signature detector of FIG. 11.

A logic flow chart for the software 160 is shown in FIG. 14 and is generally designated by the reference numeral 180.

In FIG. 14:—

"n" represents a value used by a counter;

"p" is pressure sensed by the pressure transducer 152;

"dp/dt" is the change in pressure over the change in time and is used to detect peaks, such as pressure pulses 170A-170D;

"n max" is programmed into the software prior to the apparatus 150 being run into the borehole and could be, for instance, 105 or 110.

Furthermore, the tolerance value related to timer "a" could be, for example, 1 minute or 5 minutes or 10 minutes such that there is a maximum of e.g. 1, 5 or 10 minutes that can be allowed between pulses 170A-170B. In other words, if the second pulse 170B does not arrive within that tolerance value then the counter is reset back to 0 and this helps prevent false actuation of the barrier 17.

Furthermore, the step 188 is included to ensure that the software only regards peak pressure pulses and not inverted drops or troughs in the pressure of the fluid.

Also, step 190 is included to ensure that the value of a pressure peak as shown in FIG. 13 has to be greater than 100 psi in order to obviate unintentional spikes in the pressure of the fluid.

It should be noted that step 202 could be changed to ask:—

Figure 15:
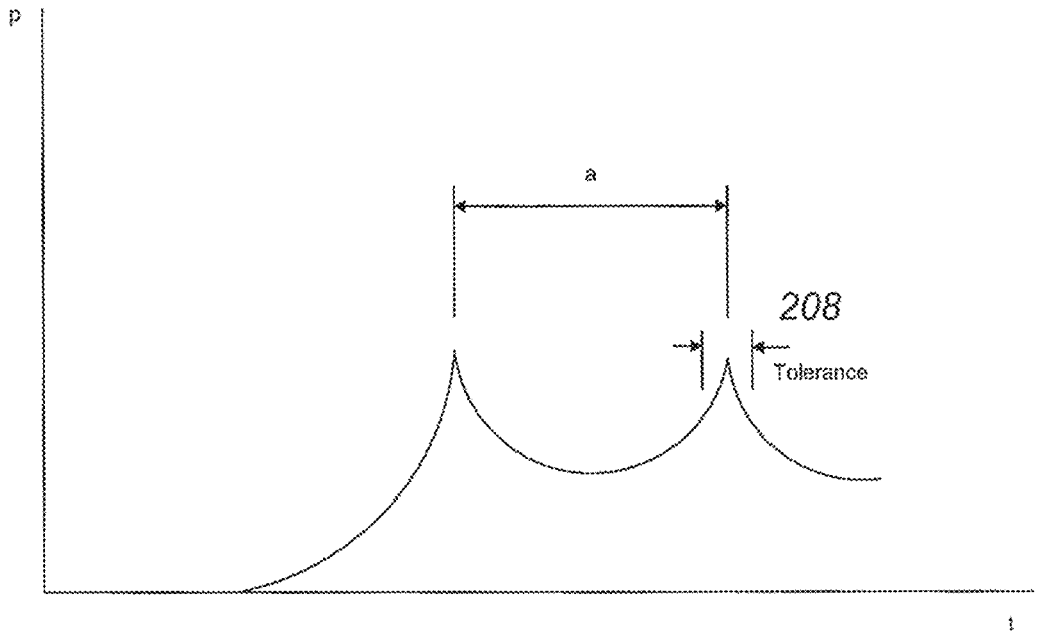
FIG. 15 is a graph of pressure versus time showing two peaks as seen and counted by the software within the microprocessor of FIG. 11.

"Is 'a' greater than a minimum tolerance value"

such as the tolerance 208 shown in FIG. 15 so that the software definitely only counts one peak as such.

Accordingly, when the software logic has cycled a sufficient number of times such that "n" is greater than "n max" as required in step 196, a signal is sent by the software to the downhole tool to be actuated (i.e. circulation sleeve sub 11, packer 13 or barrier 15) such as to open the barrier 17 as shown in step 206. The frequency pressure actuated apparatus 150 is provided with power from the battery power pack 166 via the electronics package 167.

The apparatus 150 has the advantage over conventional mechanical pressure sensors that much more accurate actuation of the tools 111, 113, 115 is provided such as opening of the barrier flapper valve 17 and much more precise control over the tools 111, 113, 17 in situations where circulation of RFID tags can't occur is also enabled.

Modifications and improvements may be made to the embodiments hereinbefore described without departing from the scope of the invention. For example, the signal sent by the software at step 206 or the RFID tags could be used for other purposes such as injecting a chemical into e.g. a chemically actuated tool such as a packer or could be used to operate a motor to actuate another form of mechanically actuated tool or in the form of an electrical signal used to actuate an electrically operated tool. Additionally, a downhole power generator can provide the power source in place of the battery pack. A fuel cell arrangement can also be used as a power source.

Furthermore, the electronics package 67 could be programmed with a series of operations at the surface before being run into the well with the rest of the completion 4 to operate each of the steps as described above in e.g. 60 days time with each step separated by e.g. one day at a time and clearly these time intervals can be varied. Moreover, such a system could provide for a self-installing completion system 4. Furthermore, the various individual steps could be combined such that for example an RFID tag or a pressure pulse can be used to instruct the electronics package 67 to conduct one step immediately (e.g. step f) of stopping circulation with an RFID tag) and then follow up with another step (e.g. step g) of opening the flapper valve barrier 15) in for example two hours time. Furthermore, other but different remote control methods of communicating with the central control units 9 could be used instead of RFID tags and sending pressure pulses down the completion fluid, such as an acoustic signalling system such as the EDGE™ system offered by Halliburton of Duncan, Okla. or an electromagnetic wave system such as the Cableless Telemetry System (CATS™) offered by Expro Group of Verwood, Dorset, UK or a suitably modified MWD style pressure pulse system which could be used whilst circulating instead of using the RFID tags.

The invention claimed is:

1. An apparatus comprising:
- a downhole barrier tool to alternatively open and close a throughbore of the apparatus;
- a downhole packer tool to alternatively open and close an annulus defined between the outer surface of the apparatus and the inner surface of a wellbore;
- a downhole circulation tool to alternatively provide and prevent a fluid circulation route between the throughbore and the annulus above the downhole packer tool;
- a downhole signal receiver and processing tool that decodes wireless signals received to operate at least one of the downhole barrier tool, the downhole packer tool, and the downhole circulation tool; and
- wherein the circulation tool is located below the signal receiver and processing tool, and both the packer tool and the barrier tool are located below the circulation tool.

2. The apparatus of claim 1, wherein the apparatus is a completion apparatus for completing a wellbore.

3. The apparatus according to claim 1 further comprising:
- a downhole actuation tool comprising a powered actuation mechanism to operate the downhole barrier tool, the downhole packer tool and the downhole circulation tool under instruction from the downhole signal received processing tool.

4. The apparatus according to claim 3, wherein the downhole signal receiver and processing tool comprises a downhole timed instruction storage means provided with a series of instructions and associated operational timings for instructing the downhole actuation tool to operate the downhole barrier tool, the downhole packer tool and the downhole circulation tool.

5. The apparatus according to claim 3, wherein the downhole signal receiver and processing tool and the downhole actuation tool are formed in one downhole tool having multiple features.

6. The apparatus according to claim 3, wherein the downhole actuation tool comprises an electrical power means which comprises an electrical power storage means in the form of one or more batteries.

7. The apparatus according to claim 6, wherein the downhole actuation tool further comprises an electrical motor driven by the batteries that provides motive power to operate, either directly or indirectly, the downhole barrier tool, the downhole packer tool and the downhole circulation tool.

8. The apparatus according to claim 6, wherein the downhole actuation tool preferably moves a piston to provide hydraulic fluid power to operate the downhole barrier tool, the downhole packer tool and the downhole circulation tool.

9. The apparatus according to claim 1, wherein the downhole circulation tool is located, within a production string, closer to the surface of the well than either of the downhole barrier tool and the downhole packer tool.

10. The apparatus according to claim 1, wherein the downhole circulation tool comprises a circulation sub.

11. The apparatus according to claim 1, wherein the downhole barrier tool comprises a valve.

12. The apparatus according to claim 11, wherein the valve comprises a ball valve or a flapper valve.

13. The apparatus according to claim 1, wherein the downhole packer tool comprises a packer or the like.

14. The apparatus according to claim 1, wherein the at least one downhole signal receiver and processing tool is capable of wirelessly receiving signals sent from the surface and comprises a radio frequency identification (RFID) tag receiving coil.

15. The apparatus according to claim 1, wherein the downhole signal receiver and processing tool comprises a second signal receiving means capable of decoding wireless signals received relating to the operation of the downhole barrier tool, the downhole packer tool and the downhole circulation tool and said second signal receiving means of the downhole signal receiver and processing tool comprises a pressure sensor.

16. A method comprising:
- i) running in an apparatus into a wellbore, the apparatus being provided at a lower end of a production tubing which is adapted to selectively contain fluid at pressure, the apparatus comprising:
  - a downhole barrier tool to alternatively open and close a throughbore of the apparatus;
  - a downhole packer tool to alternatively open and close an annulus defined between an outer surface of the apparatus and an inner surface of the wellbore;
  - a downhole circulation tool to alternatively provide and prevent a fluid circulation route between the throughbore of the apparatus and the annulus; and
  - a downhole signal receiver and processing tool that decodes wireless signals received relating to the operation of the downhole barrier tool, the downhole packer tool, and the downhole circulation tool;

ii) operating the downhole barrier tool to close the throughbore of the apparatus;

iii) increasing a pressure within the production tubing;

iv) operating the downhole packer tool to close the annulus;

v) operating the downhole circulation tool to provide a fluid circulation route between the throughbore of the apparatus and the annulus;

vi) operating the downhole circulation tool to prevent the fluid circulation route between the throughbore of the apparatus and the annulus; and vii) operating the downhole barrier tool to open the throughbore of the apparatus.

17. The method of claim 16, wherein the method is for completing a wellbore and the apparatus is a completion apparatus.

18. The method according to claim 16, wherein the downhole circulation tool is operated to provide or prevent fluid circulation through a sidewall of a completion.

19. The method according to claim 16, wherein one or more of ii), iv), v), vi) and vii) are carried out by transmitting a signal arranged to be received by a signal receiver means of the downhole signal receiver and processing tool.

20. The method according to claim 19 wherein ii), iv), v), vi) and vii) further comprise transmitting the signal without requiring an intervention into the apparatus and without requiring cables to transmit power and signals from the surface to the apparatus.

21. The method according to claim 19, wherein at least one of ii) and vi) comprise coding a means to carry data at the surface with the signal, introducing the means to carry data into the path of fluid pumped from surface to downhole such that it flows toward and through at least a portion of the apparatus such that the signal is received by the signal receiver means of the downhole signal receiver and processing tool.

22. The method according to claim 19, wherein at least one of iv), v), and vii) further comprise sending the signal via a change in the pressure of the fluid contained within the throughbore of the apparatus.

23. The method according to claim 22, wherein iv) comprises sending the signal via a predetermined frequency of changes in the pressure of the fluid contained within the throughbore of the apparatus such that a second signal receiving means of the downhole signal receiver and processing tool detects said signal.

24. The method according to claim 23 further comprising verifying that the downhole packer tool has operated to close the annulus.

25. The method according to claim 22, wherein v) further comprises sending the signal via a different predetermined frequency of changes in the pressure of the fluid contained within the throughbore of the apparatus compared to the frequency used in iv) such that a second signal receiving means of the downhole signal receiver and processing tool detects said signal and acts to operate the downhole circulation tool to provide a fluid circulation route between the throughbore of the apparatus and the annulus.

26. The method according to claim 22, wherein vii) comprises sending the signal via a different predetermined frequency of changes in the pressure of the fluid contained within the throughbore of the apparatus compared to the frequency used in iv) and v) such that a second signal receiving means of the downhole signal receiver and processing tool detects said signal and acts to operate the downhole barrier tool to open the throughbore of the apparatus.

27. The method according to claim 16, wherein iii) further comprises increasing the pressure within the production tubing to pressure test the apparatus by increasing the pressure of a fluid at the surface of the well in communication with the fluid in the throughbore of the apparatus above the closed downhole barrier tool.

28. The method according to claim 16, wherein the downhole circulation tool is run into the well in a closed configuration such that fluid cannot flow between the throughbore of the apparatus and the annulus via side ports formed in the downhole circulation tool.

29. The method according to claim 16, wherein the downhole barrier tool is run into the well in an open configuration such that fluid can flow through the throughbore of the apparatus without being impeded or prevented by the downhole barrier tool.

30. The method according to claim 16, wherein the downhole packer tool is run into the wellbore in an unset configuration such that the annulus is not closed by it during running in.

31. The method according to claim 16, wherein the method further comprises storing a series of instructions in a storage means at surface prior to running the apparatus into the wellbore.

* * * * *